United States Patent [19]

Roth

[11] 4,308,730

[45] Jan. 5, 1982

[54] ELECTRICAL PLUG LOCKING DEVICE

[76] Inventor: Donald P. Roth, 800 Lost Acre Dr., Felton, Calif. 95018

[21] Appl. No.: 130,716

[22] Filed: Mar. 17, 1980

[51] Int. Cl.[3] ..... E05B 67/06

[52] U.S. Cl. ..... 70/53; 70/57

[58] Field of Search ..... 70/57, 53, 58, 59, 60, 70/61, 62; 339/37

[56] References Cited

U.S. PATENT DOCUMENTS

| | | |
|---|---|---|
| 488,648 | 12/1892 | Covington . |
| 3,345,600 | 10/1967 | Scherer . |
| 3,416,123 | 12/1968 | Husebo . |
| 3,539,968 | 11/1970 | Tunstall . |
| 3,543,544 | 12/1970 | Efston . |
| 3,662,320 | 5/1972 | Marx . |
| 3,768,189 | 10/1973 | Goodrich . |

FOREIGN PATENT DOCUMENTS 335346 3/1921 Fed. Rep. of Germany ..... 70/59

OTHER PUBLICATIONS

Lock Kidproofs Power Tool-Popular Science, Aug., 1958, p. 185.

"TV Plug-Lok is Kid-Proof", Los Angeles Times, Part IV, p. 24, (Jul. 19, 1979).

*Primary Examiner*—Robert L. Wolfe

[57] ABSTRACT

A padlock is provided with a straight length of the shackle adapted to be received in the socket of the lock with a reduced diameter to fit within the holes in the live tines of a standard electrical plug so that the plug may not be inserted into an electrical outlet.

5 Claims, 3 Drawing Figures

ELECTRICAL PLUG LOCKING DEVICE

BACKGROUND OF THE INVENTION

Electrical appliances are frequently misused or abused, so there is a need to prevent, in a simple and inexpensive way, the unauthorized use of an electrical tool or appliance. By way of example, if parents desire to control the watching of television by children, merely unplugging the set is not sufficient. A lock is needed to prevent the insertion of the plug into an outlet except by the person controlling the lock. Similarly, electrical power tools frequently found in the home or work environment can be improperly used by those not authorized. There is, accordingly, a need for a simple and economical device for locking electrical plugs to prevent unauthorized use or damage.

While there have been locking devices for the plugs on electrical appliances, none has been a simple padlock. Either the devices have multiple and separable parts which tend to become lost or misplaced when not in use or else the devices are complex and difficult to manufacture. For example, U.S. Pat. No. 3,662,320 shows a padlock combined with a frame and a bolt into which the plug is inserted. The padlock is not an integral part of the frame or the bolt. U.S. Pat. No. 3,539,968 similarly shows a padlock with a two piece blade safety cover. Likewise, U.S. Pat. No. 3,416,123 shows a padlock with a block and a pin, all three of which may become separated and misplaced.

U.S. Pat. No. 3,345,600 shows the combination of a padlock with a single locking device having a pin riveted to side walls, thereby preventing loss of the pins, but still there is a combination of a padlock and a locking device.

U.S. Pat. No. 3,543,544 is a locking device which does not involve a padlock. Rather, it shows a complex locking device which is difficult to manufacture and sell profitably.

DESCRIPTION OF THE INVENTION

This invention consists of a padlock having a shackle and a socket, the shackle having an arm adapted to be inserted into the holes of the live tines of a standard electrical plug and then be inserted into the socket of the padlock. The lock itself thereby prevents the insertion of the plug into an electrical outlet. While the diameter of the shackle may be less than the diameter of the holes of the electrical plug throughout its length, I prefer to provide a greater diameter through the major length of the shackle to provide added strength. Only the arm inserted into the socket needs to have a reduced diameter along a length sufficient to accommodate the tines of the plug and be inserted into the socket of the lock. The live tines of two-prong electrical plugs are substantially similar to the live tines of three-prong electrical plugs so that the lock may accommodate either kind of plug.

In the preferred embodiment, the shackle may be made with the attached arm and the base of the "U" having a wider diameter and the arm adapted for insertion into the socket with a reduced diameter. The diameter may be reduced by either milling or otherwise machining the arm, or it may be forged with the reduced diameter.

While the lock may be either a key lock or a combination lock, as the user desires, it is preferred to have a combination lock so that there are no separable elements to the combination which might become lost or misplaced. A combination lock incorporating the present invention involves only a single device without any separable parts.

DESCRIPTION OF THE PREFERRED EMBODIMENTS

Figure 1:
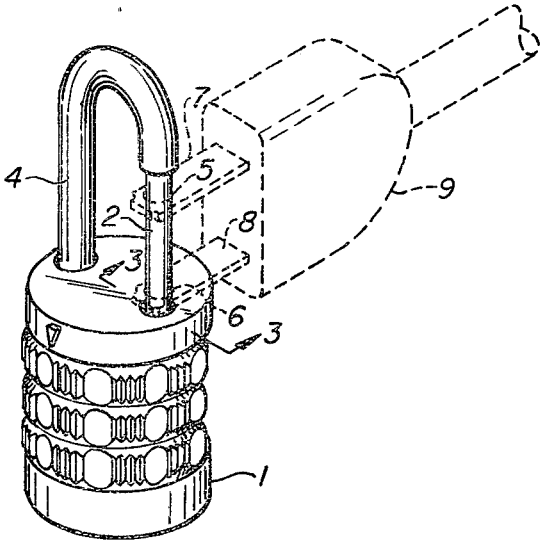
FIG. 1 is a perspective view of a combination lock incorporating the invention in a closed position with a two-prong electrical plug outlined in phantom.

FIG. 1 is a perspective view of a combination lock housing 1 having a milled down length 2 of a shackle 4 which is inserted through hole 5 of prong 7 and hole 6 of prong 8 of an electrical plug 9 and into the lock socket 3 of the lock housing 1.

Figure 2:
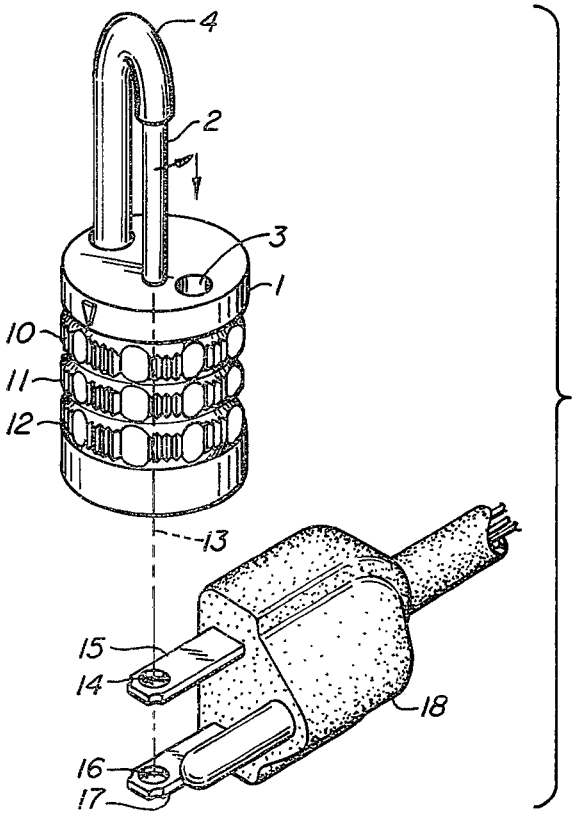
FIG. 2 is a perspective view of a combination lock incorporating the invention in an open condition adapted to be used with a three-prong electrical plug.

FIG. 2 is a perspective view of the combination lock housing 1 showing the milled down length 2 of shackle 4 disengaged from the lock socket 3 by operation of the combination tumblers 10, 11, 12 and aligned for insertion into hole 14 of prong 15 and hole 16 of prong 17 of a standard three prong electrical plug 18.

Figure 3:
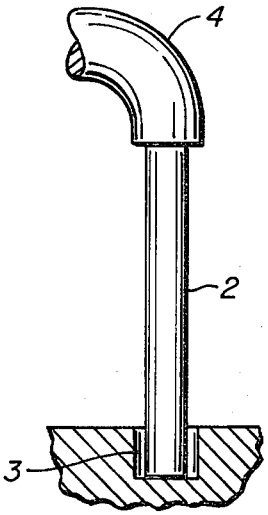
FIG. 3 is a cross-sectional view of a lock housing with an arm of the shackle inserted in the socket.

FIG. 3 shows a milled down length 2 of a portion of the shackle 4 inserted into lock socket 3, shown in cross-section.

The reduced diameter portion of the shackle must be of small enough diameter for ease of insertion into a variety of prong hole sizes. It must be of sufficient length to hold two prongs of a standard size plug when the shackle is inserted into a locked position in the socket. Shackles on combination locks are generally constructed of material strong enough to resist manual bending without tools. It is preferable that the narrower diameter portion of the shackle be formed integrally with the rest of the shackle rather than be a separate piece attached to a wider diameter shackle, because a welded or bonded length of narrower diameter would be susceptible to breakage or bending.

In the United States, the live tines of electrical plugs are typically about 14 millimeters apart, as measured on the outer surfaces. In order to allow both tines to be secured by the shackle and the arm of the shackle secured in the socket, I prefer to either machine or forge a length of about 19 millimeters of reduced diameter. This permits about 3 millimeters in the socket, to be secure against bending for removal, and about 16 millimeters to hold the plug. The diameter of the holes in the tines is in excess of 3 millimeters, so I prefer to make the length of the shackle of reduced diameter between 2.9 and 3.0 millimeters in diameter.

It will be apparent that a conventional padlock may be adapted for controlling the unauthorized use of electrical apparatus having a standard electrical plug by means of the of the present invention. It is to be understood that the foregoing description is only by way of example, and is not intended to limit the scope of the invention.

What is claimed is:

1. In a padlock having a socket and a shackle, the improvement comprising a straight length of the shackle adapted to be received in the socket having a diameter less than the diameter of the openings in live tines of a standard electrical plug, and a length greater than the distance between the outer surfaces of the tines.

2. A padlock as in claim 1 adapted to be opened by a key.

3. A padlock as in claim 1 adapted to be opened by a combination.

4. A padlock as in claim 1 wherein the shackle is machined to provide a length of reduced diameter.

5. A padlock as in claim 1 wherein the shackle is forged with at least a straight length of the specified diameter.

* * * * *